US006992582B2

(12) United States Patent
Hill et al.

(10) Patent No.: US 6,992,582 B2
(45) **Date of Patent: *Jan. 31, 2006**

(54) SYSTEM AND METHOD FOR TRACKING MOVEMENT OF INDIVIDUALS

(75) Inventors: Maurice L. Hill, Fairfax, VA (US); Michael Mocenter, Warminster, PA (US); Joeseph S. Reiter, Warminster, PA (US); Paul Viola, Arlington, VA (US); Brian Moran, Arlington, VA (US)

(73) Assignee: Satellite Tracking of People LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/677,272

(22) Filed: Oct. 3, 2003

(65) Prior Publication Data

US 2005/0099308 A1 May 12, 2005

Related U.S. Application Data

(63) Continuation of application No. 09/964,879, filed on Sep. 28, 2001, now Pat. No. 6,703,936.

(51) Int. Cl.
*G08B 1/08* (2006.01)

(52) U.S. Cl. ..... 340/539.13; 340/573.4; 340/825.49; 340/693.5; 455/456; 455/457

(58) Field of Classification Search ..... 340/539.13, 340/539.12, 573.1, 573.3, 573.4; 455/456, 455/457, 404.2
See application file for complete search history.

(56) References Cited

U.S. PATENT DOCUMENTS 4,673,936 A 6/1987 Kotoh
4,705,211 A 11/1987 Honda et al.
4,741,245 A 5/1988 Malone
4,747,120 A 5/1988 Foley
4,750,197 A 6/1988 Denekamp et al.
4,819,053 A 4/1989 Halavais
4,885,571 A 12/1989 Pauley et al.
5,019,828 A 5/1991 Schoolman
5,043,736 A 8/1991 Darnell et al.
5,146,231 A 9/1992 Ghaem et al.
5,223,844 A 6/1993 Mansell et al.

(Continued)

FOREIGN PATENT DOCUMENTS

WO WO 00/77688 12/2000

OTHER PUBLICATIONS

B. Clede, "Radio computers locate places, and plot them on a map, too", Law and Order, Oct. 1994, http://www.clede-.com/Articles/Police/gps.htm.

(Continued)

*Primary Examiner*—Benjamin C. Lee
(74) *Attorney, Agent, or Firm*—Steptoe & Johnson LLP

(57) ABSTRACT

A device for monitoring movement of an object is provided. A first module is configured to secure to the object. A second module, capable of electrically connecting to the first module, includes at least a rechargeable battery and a memory capable of storing a history of movement data. A third module, capable of electrically connecting with the second module, includes a data modem capable of connecting to a remote station, and a battery charger. When the second module is connected to the first module, the memory periodically records available location data representing a position of the device at the time of recording. When the second module is connected to the third module, the memory downloads through the data modem and the battery charger charges the battery.

13 Claims, 10 Drawing Sheets

U.S. PATENT DOCUMENTS 5,266,958 A 11/1993 Durboraw, III
5,298,884 A 3/1994 Gilmore et al.
5,317,309 A 5/1994 Vercellotti et al.
5,334,974 A 8/1994 Simms et al.
5,392,052 A 2/1995 Eberwine
5,396,227 A 3/1995 Carroll et al.
5,416,468 A 5/1995 Baumann
5,416,695 A 5/1995 Stutman et al.
5,418,537 A 5/1995 Bird
5,437,278 A 8/1995 Wilk
5,461,365 A 10/1995 Schlager et al.
5,461,390 A 10/1995 Hoshen
5,493,694 A 2/1996 Vlcek et al.
5,497,149 A 3/1996 Fast
5,528,248 A 6/1996 Steiner et al.
5,537,102 A 7/1996 Pinnow
5,541,845 A 7/1996 Klein
5,544,661 A 8/1996 Davis et al.
5,552,772 A 9/1996 Janky et al.
5,559,497 A 9/1996 Hong
5,568,119 A 10/1996 Schipper et al.
5,627,548 A 5/1997 Woo et al.
5,652,570 A 7/1997 Lepkofker
5,731,757 A * 3/1998 Layson, Jr. ..... 340/5.61
5,742,233 A * 4/1998 Hoffman et al. ..... 340/573.1
5,748,148 A 5/1998 Heiser et al.
5,825,871 A 10/1998 Mark
5,867,103 A 2/1999 Taylor, Jr.
5,868,100 A 2/1999 Marsh
5,889,474 A 3/1999 LaDue
5,892,454 A 4/1999 Schipper et al.
5,905,461 A * 5/1999 Neher ..... 342/357.07
5,912,623 A 6/1999 Pierson
5,919,239 A 7/1999 Fraker et al.
5,936,529 A 8/1999 Reisman et al.
5,940,004 A * 8/1999 Fulton ..... 340/825.49
5,959,533 A 9/1999 Layson, Jr. et al.
5,963,130 A 10/1999 Schlager et al.
5,982,281 A 11/1999 Layson, Jr.
6,014,080 A * 1/2000 Layson, Jr. ..... 340/539
6,031,454 A 2/2000 Lovejoy et al.
6,054,928 A 4/2000 Lemelson et al.
6,072,392 A * 6/2000 Henderson et al. .... 340/539.15
6,072,396 A 6/2000 Gaukel
6,100,806 A 8/2000 Gaukel
6,104,295 A 8/2000 Gaisser et al.
6,122,521 A * 9/2000 Wilkinson et al. ..... 455/457
6,130,620 A 10/2000 Pinnow et al.
6,160,481 A 12/2000 Taylor, Jr.
6,198,394 B1 3/2001 Jacobsen et al.
6,218,945 B1 4/2001 Taylor, Jr.
6,232,916 B1 5/2001 Grillo et al.
6,236,319 B1 5/2001 Pitzer et al.
6,239,700 B1 5/2001 Hoffman et al.
6,262,666 B1 7/2001 Lodichand
6,346,886 B1 * 2/2002 De La Huerga ..... 340/573.1
6,362,778 B2 * 3/2002 Neher ..... 342/357.07
6,405,213 B1 * 6/2002 Layson et al. ..... 340/539
6,571,193 B1 * 5/2003 Unuma et al. ..... 702/141
6,669,682 B1 * 12/2003 Gibson et al. ..... 604/890.1
6,674,368 B2 * 1/2004 Hawkins et al. ..... 340/573.4
6,801,137 B2 * 10/2004 Eggers ..... 340/870.09

OTHER PUBLICATIONS

G.W. Brown, Jr., "What impact will personal position location technology have upon the management and administration of mid-sized law enforcement organizations by the year 2000?", California Commission on Peace Officer Standards and Training, Sacramento, California, Jul. 1994.

D. Anderson, "Seattle and Tacoma PDs Automated Crime Analysis", The Journal, National FOP Journal, Spring 1990.

B. Wise, "Catching Crooks With Computers", American City & County, May 1995, pp. 54-62.

M. Alexander et al., "An Automated System for the Indentification and Prioritization of Rape Suspects", SDSS For Rape Suspect Indentification, http://www.esri.com/library/userconf/proc97/proc97/to350/pap333/p333.htm, Jul. 2001.

R. Block, "Geocoding of Crime Incidents Using the 1990 TIGER File: The Chicago Example", Loyola University, Chicago, Chapter 15, pp. 189-193.

L. Pilant, "Spotlight on . . . High-Technology Solutions", From Police Chief, Document #54650, May 1996.

M. Lyew, "A new weapon for fighting crime".

American Probation and Parole Association, "Electronic Monitoring", 1996, http://www.appa-net.org/about%20appa/electron.htm.

D. Evans, "Electronic Monitoring: Testimony to Ontario's Standing Committee on Administration of Justice", Perspectives, Fall 1996, pp. 8-10.

A.W. Cohn et al., "The Evaluation of Electronic Monitoring Programs", Perspectives, Fall 1996, pp. 28-37.

B.L. Huskey, "Electronic Monitoring: An Evolving Alternative", Perspectives, Summer 1987, pp. 19-23.

J.M. Byrne et al., "Understanding the Limits of Technology: An Examination of the Use of Electronic Monitoring in the Criminal Justice System", Perspectives, Spring 1988, pp. 30-37.

M. Anderson (editor), "GPS Used to Track Criminals", GIS WORLD, Aug. 1996, p. 15.

M.T. Charles, "The Development of a Juvenile Electronic Monitoring Program", Federal Probation, Jun. 1989, vol. III, pp. 3-12.

J. Hoshen et al, "Keeping Tabs on Criminals", Spectrum, The Institute of Electrical and Electronics Engineers, Inc., Feb. 1995, pp. 26-32.

* cited by examiner

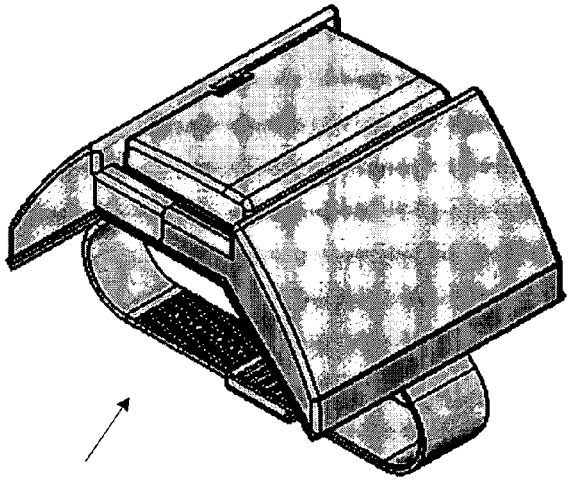
Fig. 1
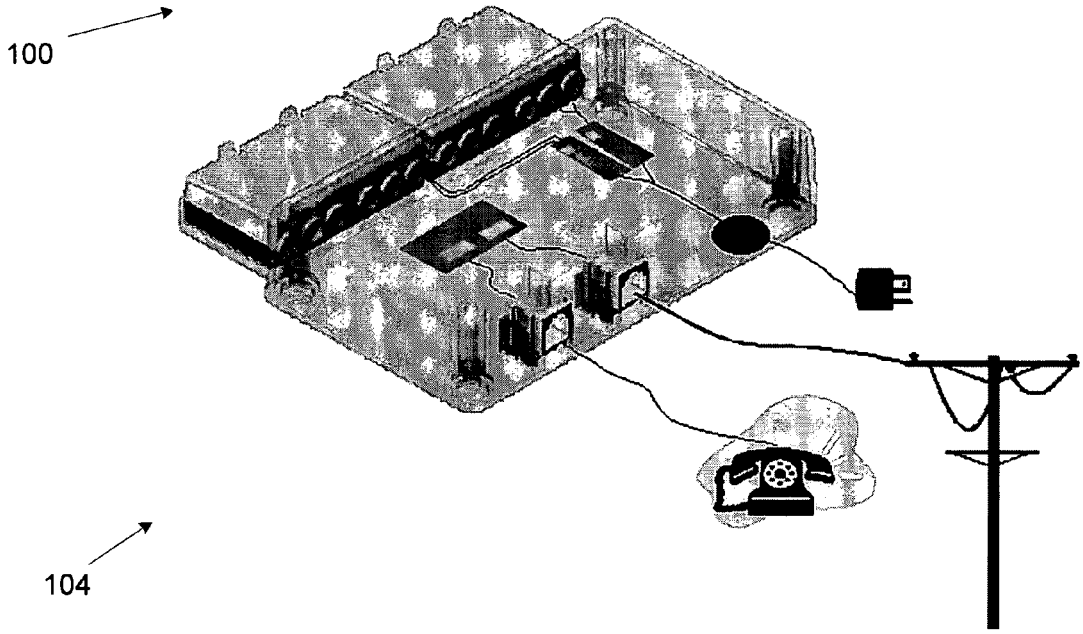

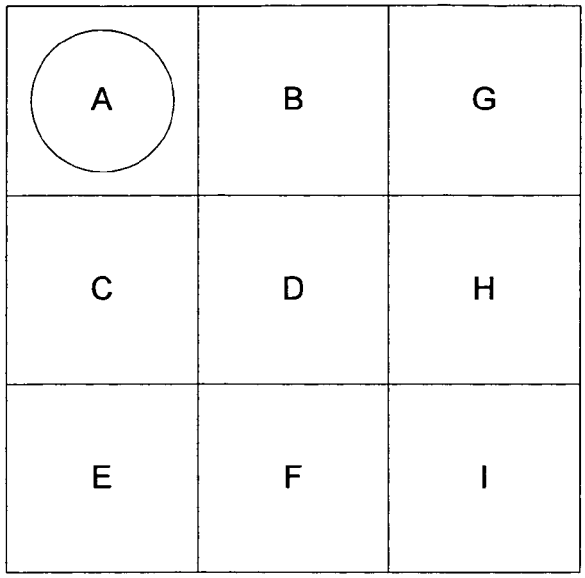
Fig. 10
Fig. 11
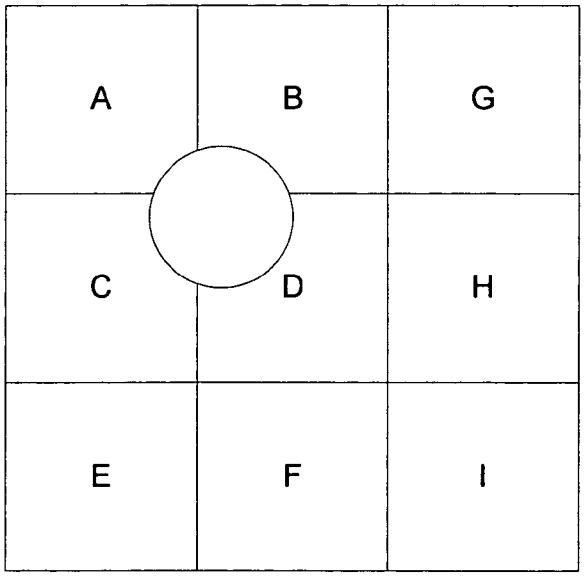

SYSTEM AND METHOD FOR TRACKING MOVEMENT OF INDIVIDUALS

This application is a continuation of application Ser. No. 09/964,879, filed Sep. 28, 2001.

BACKGROUND OF THE INVENTION

1. Field of the Invention

The present invention relates to a device for passively tracking individuals. More specifically, the present invention is directed to a device for recording the movement of individuals using GPS signals for later comparison with event data to determine if the individual was in the vicinity of the event within a given time frame.

2. Discussion of Background Information

Devices and methods for monitoring the movements of individuals are known. One example is a two-piece tracking unit that includes a tag attached to a limb of a wearer (e.g., on the wrist) tethered to a large suitcase or body-worn unit that carries batteries and associated circuitry. This device is an "active" system in that it compares its position with certain ongoing restrictions to detect violations (e.g., a parolee enters a restricted area, such as a bar). The requirements of this type of active system dictate the large size and weight of this system. The associated manufacturing and operating costs have limited the commercial viability of these devices, such that it is believed that less than 1500 units are in actual use in the United States.

Smaller one-piece wearable units have been suggested, such as in U.S. Pat. No. 5,867,103 to Taylor and PCT/US00/16092 to Layson. Both disclose a self-contained device that can be worn around an individual's limb. The devices include standard GPS receiving circuitry, a memory, a power source, and some methodology to download the contents of the memory to a remote station for comparison with other data, typically crime data.

A drawback of the Taylor device is that it fails to account for the power supply and management system necessary to make these devices commercially viable. Specifically, the power requirements of the Taylor device would only allow for short-term use based on available battery technology. Layson addresses this problem with various battery recharging schemes such as solar cells and high-speed inductive transfer. However, these procedures are not believed to be commercially viable. It is believed that efforts to solve these problems have focused on improved batteries and lower power consumption methodologies that would provide extensive use (on the order of thirty days) between recharges. To date, this approach has not proved successful.

A need therefore exists for a relatively small wearable tracking unit and associated methodology with a high commercial viability.

The above noted prior art devices produce location data that reflect a user's location over time. This location data can be compared with incident data, such as crime data, to determine whether the user was in the area at the time of the incident. The noted Layson application contemplates that a database of several crime incidents can be compared with a database of movement of multiple users to identify instances of overlap. However, this type of comparison of raw databases would tax current computer limitations and be slow to produce results. Swifter analysis is preferable in these matters (if for no other reason than to minimize opportunity for criminal flight).

SUMMARY OF THE INVENTION

The present invention provides a device capable of monitoring the movement of a person.

According to an embodiment of the invention, a device for monitoring movement of an object is provided. A first module is configured to secure to the object. A second module, capable of electrically connecting to the first module, includes at least a rechargeable battery and a memory capable of storing a history of movement data. A third module, capable of electrically connecting with the second module, includes a data modem capable of connecting to a remote station, and a battery charger. When the second module is connected to the first module, the memory periodically records available location data representing a position of the device at the time of recording. When the second module is connected to the third module, the memory downloads through the data modem and the battery charger charges the battery.

Various options and features are preferably present in conjunction with the above embodiment. A band is capable of securing the first module to the object, the band being an electrically conductive plastic. The first module includes a coordinate receiver, and the battery powers the receiver when the first module is electrically connected to the second module. A fourth module is interchangeable with the second module. An initialization module capable of initializing the memory may be provided. The first and second modules, when connected, have a size and shape for easy support around the limb of a user.

According to another embodiment of the invention, a system for monitoring movement of an object is provided. A first module is configured to secure to the object, and includes a coordinate receiver and an antenna. A plurality of second modules are each capable of electrically connecting to the first module, and each include at least a rechargeable battery and a memory capable of storing a history of movement data from the coordinate receiver. A third module, capable of electrically connecting with at least one of the second modules, includes a data modem capable of connecting to a remote station, and a battery charger.

Various options and features are preferably present in conjunction with the above embodiment. By way of non-limiting example, when one of the second modules is connected to the first module, the memory periodically records available location data representing a position of the device at the time of recording, and when the one of the second modules is removed from the first module and connected to the third module, the memory downloads through the data modem and the battery charger charges the battery. Tamper detection circuitry in the first module is capable of logging a tamper event in the memory in response to attempted removal of the first module from the object.

According to yet another embodiment of the invention, a method for recording movement of an object, wherein a first module is attached to the object in a tamper resistant manner is provided. The method includes electrically connecting a second module to the first module, the second module including at least a memory and a battery, obtaining data representing a position of the first module at a particular time, storing the data on the memory in the second module, repeating the obtaining and storing for a period of time, after the period of time, disconnecting the second module from the first module and connecting the second module to a third module, the third module including at least a data modem and a battery charger, downloading the contents of the memory in the second module to a remote location through the data modem, and recharging the battery in the second module via the battery charger in the third module.

Various options and features are preferably present in conjunction with the above embodiment. By way of non-limiting example, at least one fourth module includes at least a memory and a battery. This embodiment preferably includes connecting the fourth module to the third module substantially when the second module is connected to the first module, and connecting the fourth module to the second module substantially when the second module is connected to the third module. The embodiment preferably includes storing tamper data in the memory in response to an attempt to remove the first module from the object.

According to still yet another embodiment of the invention, a method for recording movement of an object is provided. A first module is attached to the object in a tamper resistant manner, a plurality of second modules each include at least a memory and a battery, and a third module is configured to simultaneously connect with at least some of the plurality of second modules. The method of the embodiment includes connecting one of the plurality of second modules to the first module, connecting at least some of the plurality of second modules to the third module, obtaining, at the first module, data representing a position of the first module at a particular time, storing the data on the memory in the one of the plurality of second modules, repeating the obtaining and storing for a period of time, after the period of time, substituting the one of the plurality of second modules with one of the at least some of the plurality of second modules, such that the obtaining, storing, and repeating will continue with the one of the at least some of the plurality of second modules, connecting the one of the plurality of second modules to the third module, downloading the contents of the memory in the one of the plurality of second modules to a remote location through the data modem, and recharging the battery in the one of the plurality of second modules via the battery charger in the third module.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein:

FIG. 1 shows the preferred embodiment of the invention;

FIGS. 10 and 11 show an area broken into zones relative to an area of interest about a crime.

DETAILED DESCRIPTION OF THE EXEMPLARY EMBODIMENT

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIG. 1 shows a system 100 for monitoring the movement of a person. System 100 includes a user worn device 102 and a stationary transmitter 104. User worn device preferably fits around a user's extremity, and particularly about the wrist.

Figure 2:
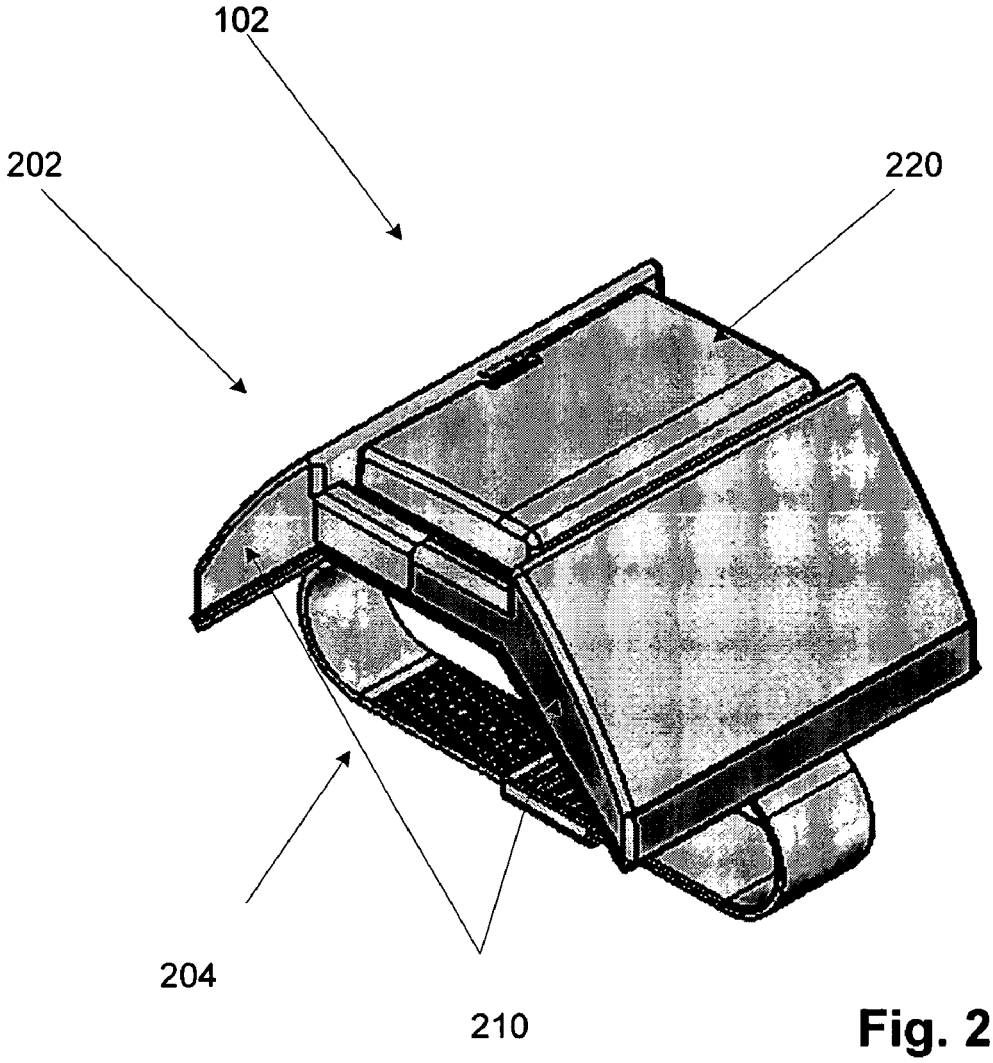
FIG. 2 is a perspective view of the user wearable modules of the invention according to an embodiment of the invention.

FIG. 2 shows user worn device 102 configured for attachment about the wrist. User worn device 102 includes a circuit portion 202 and a band 204. Band 204 is preferably made from a material that can form a closed circuit about the wrist, such as electrically conductive plastic, or cloth or leather with conductive material woven therein. As discussed below, the system will detect any tampering with band 204 (e.g., cutting).

Circuit portion 202 includes a fixed module 210 and a removable module 220. Fixed module 210 is attached to band 204, and thus not removable from the user absent tampering. Both fixed module 210 and removable module 220 are preferably configured with mating surfaces to allow for insertion, retention and removal of removable module 220 from fixed module 210.

Figure 3:
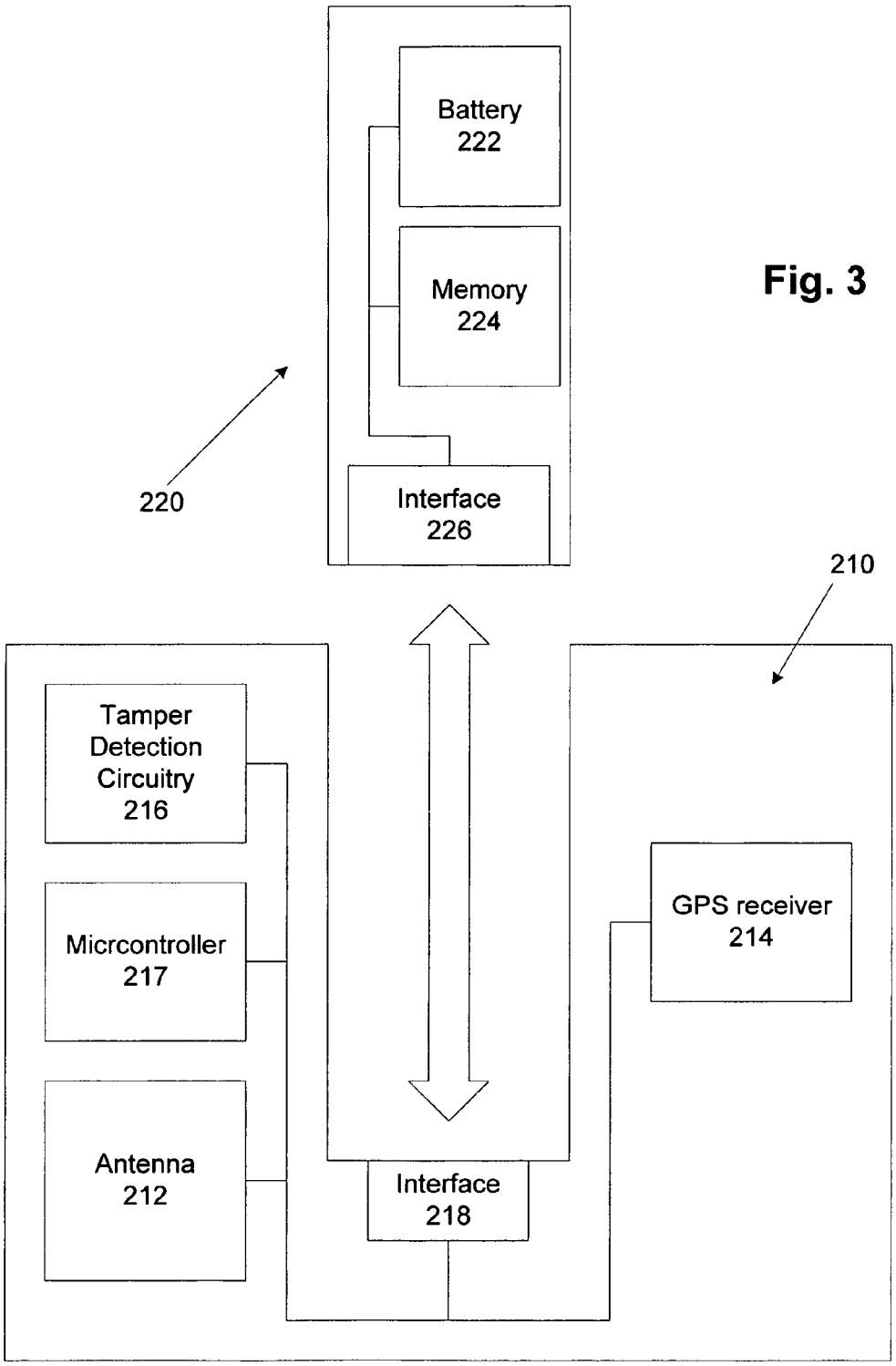
FIG. 3 is a block diagram of the components of the wearable modules of the invention.

FIG. 3 shows a block diagram of fixed module 210 in combination with removable module 220. Fixed module 210 preferably includes an antenna 212, a GPS receiver 214 (preferably the Trimble-Lasson low power Global Positioning System receiver), tamper detection circuitry 216, a microcontroller 217, and an interface 218. Removable module 220 preferably includes a rechargeable battery 222, a memory 224 capable of storing movement data, and an interface 226. The exact position orientation of these circuit elements and the interconnections therein are not limited to those shown, and may be configured as convenient by those of skill in the art.

Figure 4:
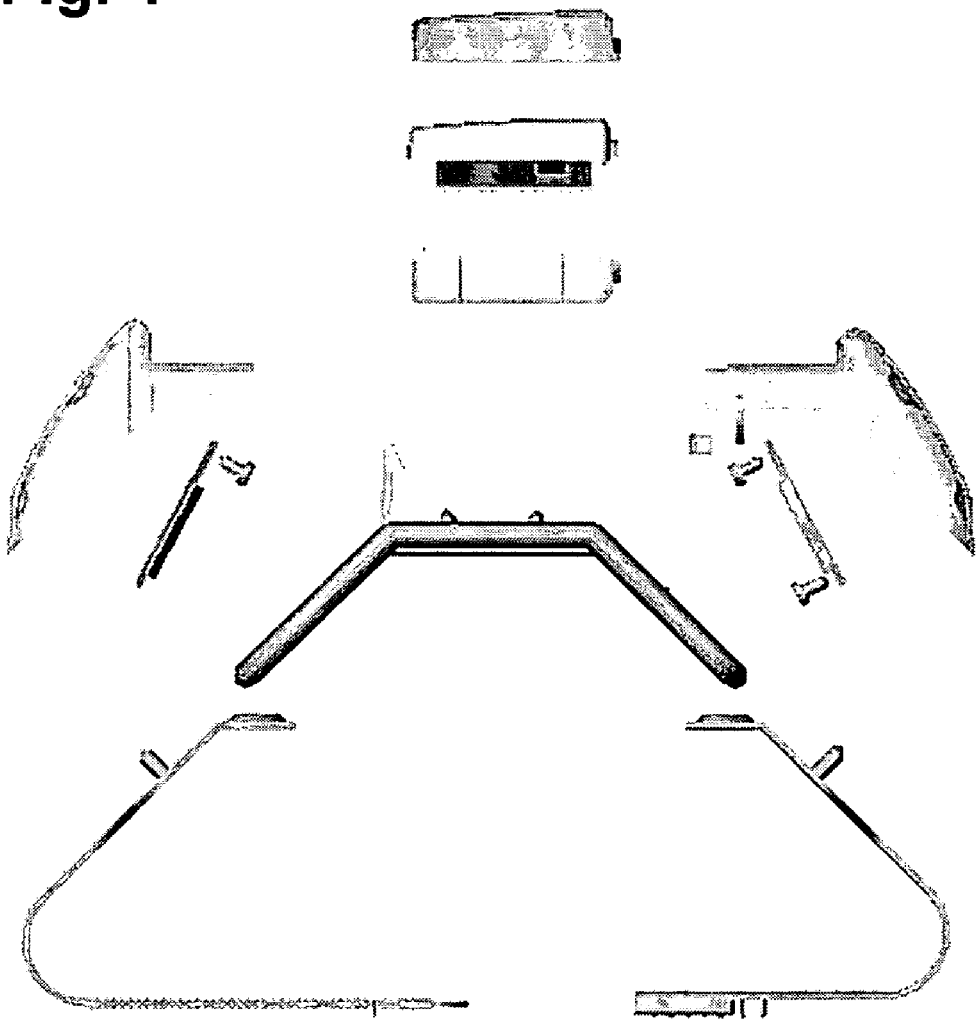
FIGS. 4 and 5 are exploded views of the wearable modules of the invention.
Figure 5:
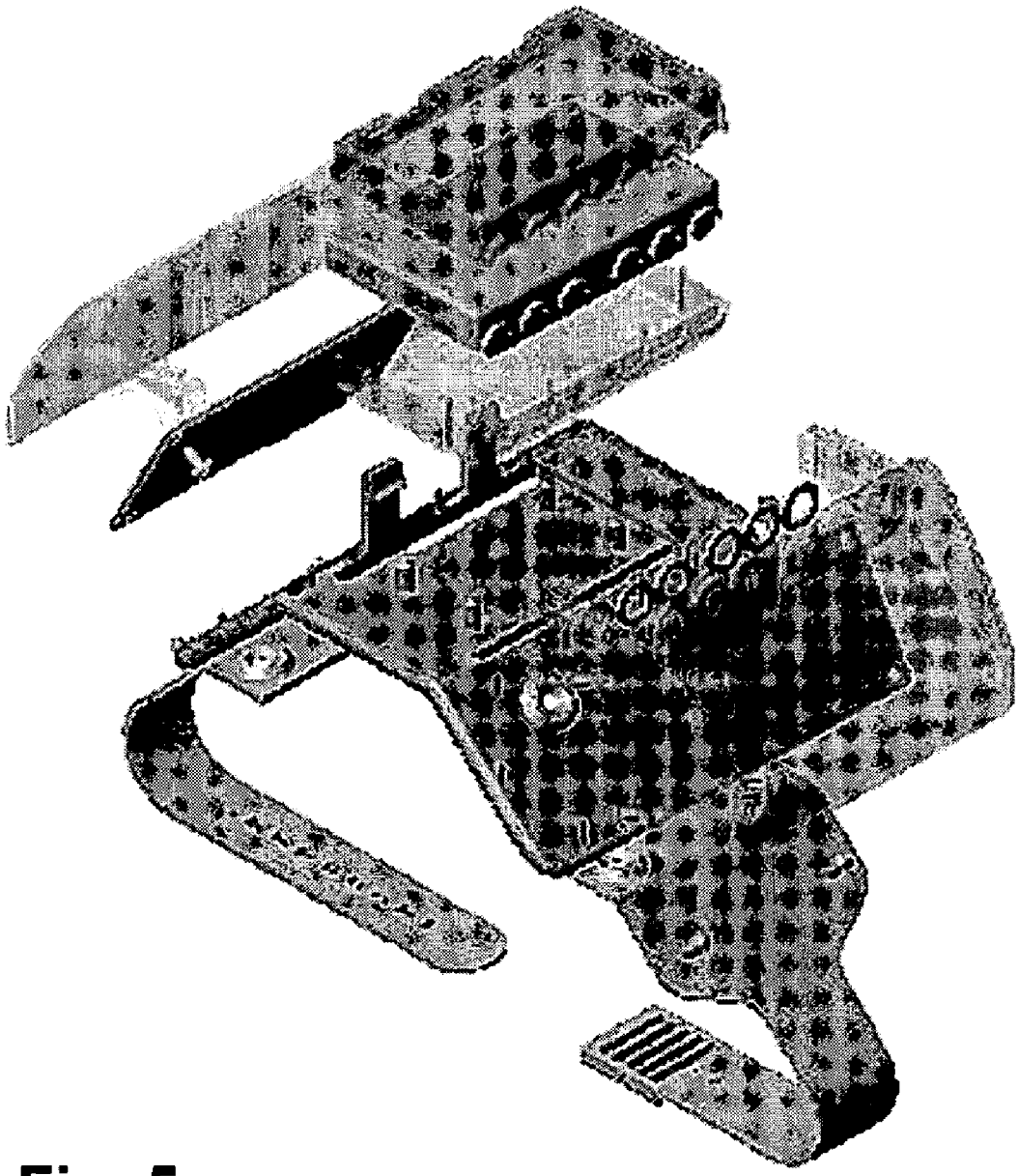

FIGS. 4 and 5 illustrate a preferred embodiment of circuit portion 202 and band 204. Fixed module 210 preferably has a curved radius on all sides adjacent to and away from the body to conform to the shape of an arm or wrist. Band 204 is made of male and female conductive flexible thermoplastic straps, which attach to a base of fixed module 210 that supports removable module 220. The male/female connections are preferably the same as that used in cable ties that are not removable absent damage to band 204, although other methods may be used.

At least one heat stake stud projects from the ends of band 204 to attach band 204 to the base area of fixed module 210 that receives removable module 220. This area is preferably made from flame retardant ABS (Acrylonitrile Butadiene Styrene) shaped into a three-sided platform. A latch fits over the side of an inserted removable module 220 battery to secure it in the appropriate position. Wire bonded to ends of band 204 with conductive epoxy, bridges the ends of band 204 to tamper detection circuitry 216, forming a tamper-proof loop. If the circuit is broken or interrupted, tamper detection circuitry 216 issues alarm data to memory 224.

Tamper detection circuitry 216 can also monitor the "health" of GPS receiver 214 and antenna 212 to detect any tampering and issue appropriate alarm data to memory 224.

A microcontroller board cover 230 molded from flame retardant ABS is mounted on one side of fixed module 210. Attached to the underside of this cover is a circuit board that supports microcontroller 217, tamper detection circuit 216, and antenna 212. A small capacitor can optionally be implanted on the microcontroller circuit board to power memory 224 in the event battery 222 fails. Microcontroller board cover 230 has six phosphor bronze contacts that mate with removable module 220.

On the opposite side of fixed module 210 is a GPS board cover 240 made of flame retardant ABS. GPS receiver 214 is attached to the underside of GPS board cover 240. GPS board cover 240 attaches by ultrasonic bonding of the plastic material, thus making it waterproof and tamper resistant.

Removable module 220 attaches/connects to the center face of the fixed module 210. Rechargeable battery 222 is preferably a 3.7 volt lithium-ion prismatic rechargeable battery encased between flame retardant ABS top and bottom covers, and preferably powers the modules for 32 hours when fully charged.

Figure 6:
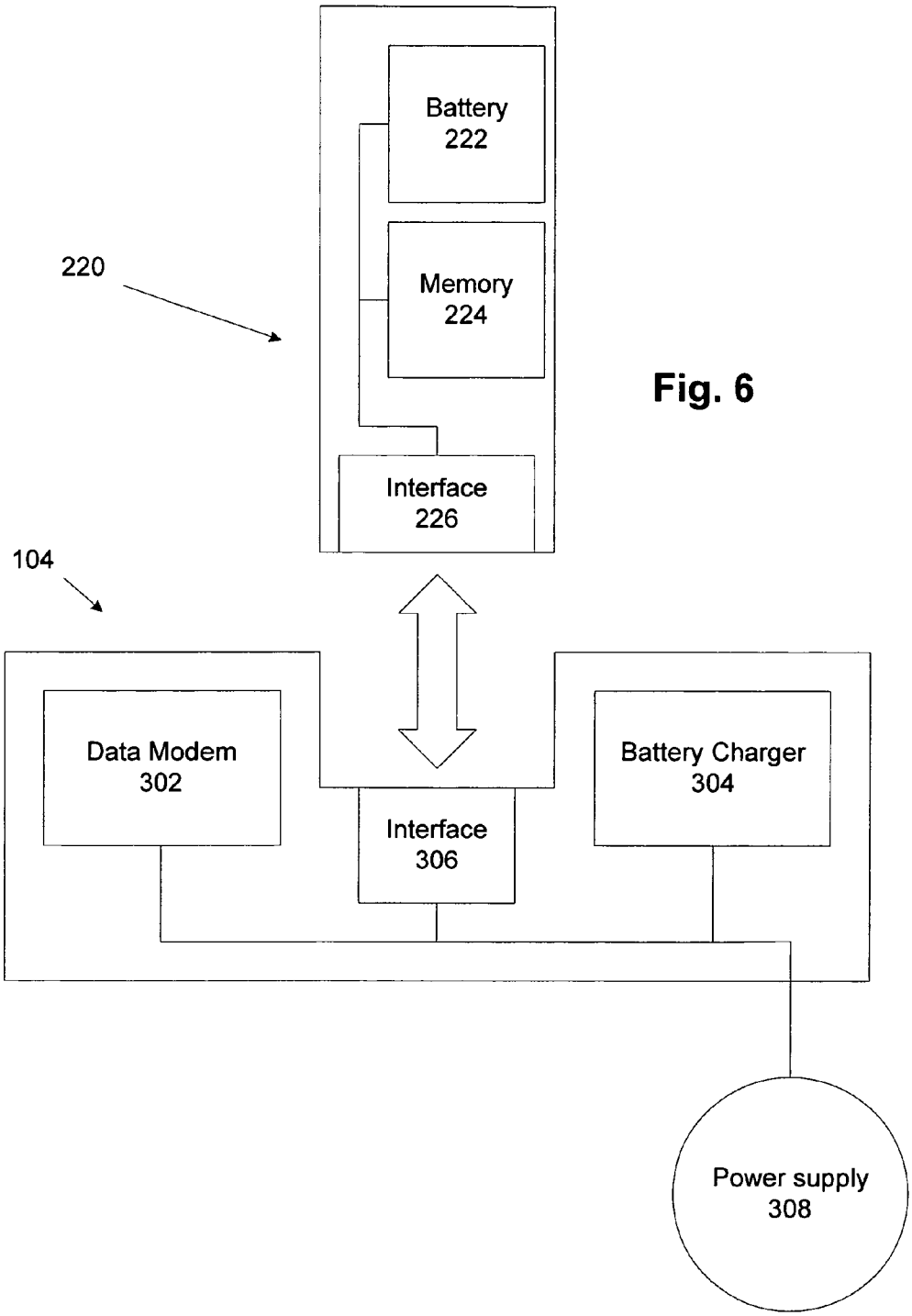
FIG. 6 is a block diagram of the removable module and stationary transmitter module.

FIG. 6 shows a block diagram of stationary transmitter 104. Transmitter 104 includes a data modem 302, a battery charger 304, and an interface 306. Transmitter 104 receives power from an external power supply 308, preferably a standard wall outlet with an appropriate AC/DC level converter. Data modem 302 is preferably either a wireless or landline modem capable of transmitting data over an existing phone line to a remote location.

Figure 7:
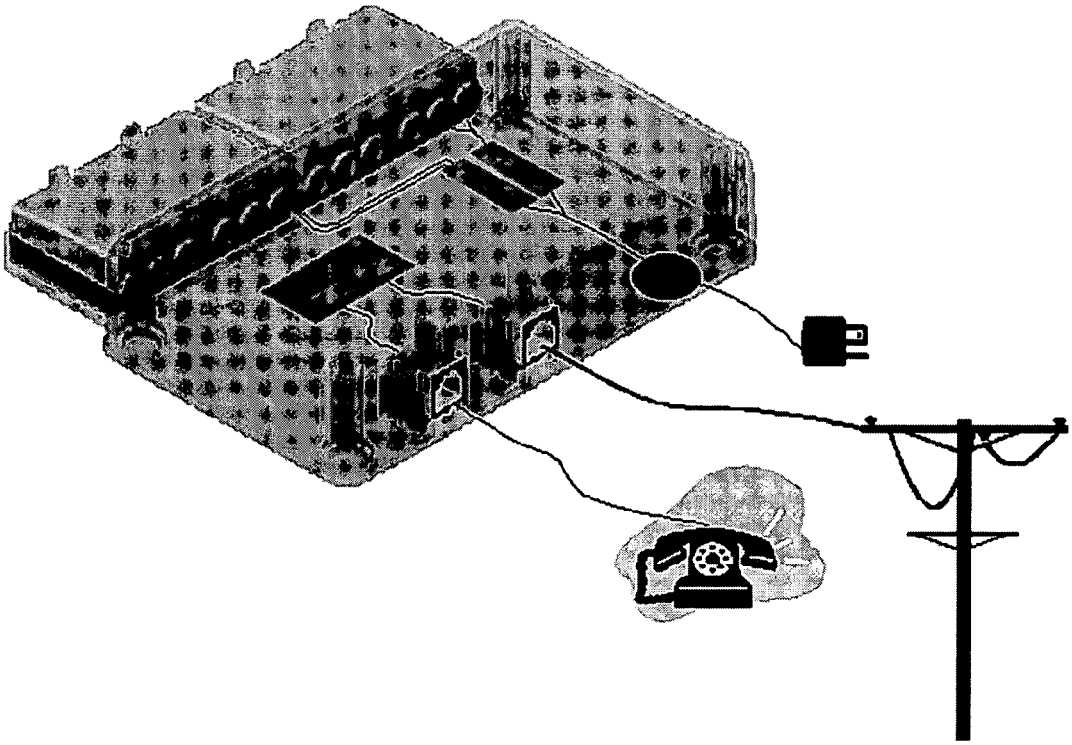
FIG. 7 is a perspective view of a the removable modules and stationary transmitter module.

FIG. 7 shows a preferred embodiment of stationary transmitter 104. In this embodiment, there are three removable modules 220, two of which are mounted in stationary module 104, and a third is used with fixed module 210 (not shown in FIG. 7). Data modem 302 is a landline modem (shown by the standard telephone jacks). The noted interfaces are simply electrical contacts with associated circuit paths to connect the desired electronic elements. Power supply 308 is a 6-volt DC modular power supply running from an adapter connected to a standard wall outlet. Power supply 308 powers two battery charger circuit boards, each of which connect to two of twelve data/power interface clips of interface 306. Stationary module 104 also includes a download unit circuit board, which may include an appropriate microcontroller that controls the data downloading process.

In practice, the user will take one of the freshly charged removable modules 220 to replace the in-use removable module 220 when appropriate. Rotation of the modules is preferred, but not required.

Interfaces 218, 226, and 306 may be of any preferred design, including separate electronic circuits or simply mating metal contacts or leads.

In operation, the user inserts removable module 220 into fixed module 210 such that interface 218 connects with interface 226. Battery 222 supplies power to GPS receiver 214, which will begin to receive location data from the GPS coordinate satellite system. Fixed module 210 preferably also has circuitry to complete a circuit path between receiver 214 and memory 224, such that memory 224 will periodically record GPS data from receiver 214 as movement data. The GPS data may be the "raw" data from the GPS satellite network, or may be coordinate data derived by GPS receiver 214 from the raw data. The sampling rate is preferably at least once per minute, but other sampling rates may be used. Memory 224 will thus log the movement of fixed module 210 over time.

If the monitored object/user enters certain buildings, underground garages or other areas that GPS receiver 214 cannot receive signals from the GPS network, then either microcontroller 217 or GPS receiver 214 can generate a time stamp from an internal clock to store in memory 224, such that the movement data would only be the timestamp during these periods.

After some period of time (which is preferably predetermined, and particularly approximately 24 hours of use), the user removes the "original" removable module 220 and replaces it with an identical "spare" removable module 220 with a preferably freshly charged battery 222 and clear memory 224. A contributing factor to this time period is the battery life of battery 222, which is preferably at least 24–36 hours when fully charged, and particularly 32 hours.

The user inserts the original removable module into the transmitter 104 to connect interface 226 and 306. Both removable module 220 and transmitter 104 are preferably configured with mating surfaces to allow for insertion, retention, and removal of removable module 220. When connected, battery charger 304 recharges battery 222. Data modem 302 responds to the presence of memory 224 by attempting to connect to a remote location (not shown). When the telephone connection is established, memory 224 downloads the stored location history through data modem 302. This may occur automatically, upon receipt of a request signal from the remote location, or by another triggering methodology. After successful download, memory 224 clears. Again, this may be done automatically, upon receipt of an appropriate signal from the remote location, or by another methodology.

When the user inserts removable module 220 into transmitter 104, the external power supply 308 preferably powers data modem 302 and memory 224. Since the external power source 308 preferably powers the download of memory 224 rather than battery 222, battery 222 has a longer useful charge for recording location data when the removable module 210 is inserted into the fixed module 220.

By continually rotating between two or more removable modules 220, the above embodiment can continuously record a user's location except for the few moments that it takes to switch between modules. The user is also not tethered to the transmitter 104, and can thus move about freely during data download.

Figure 8:
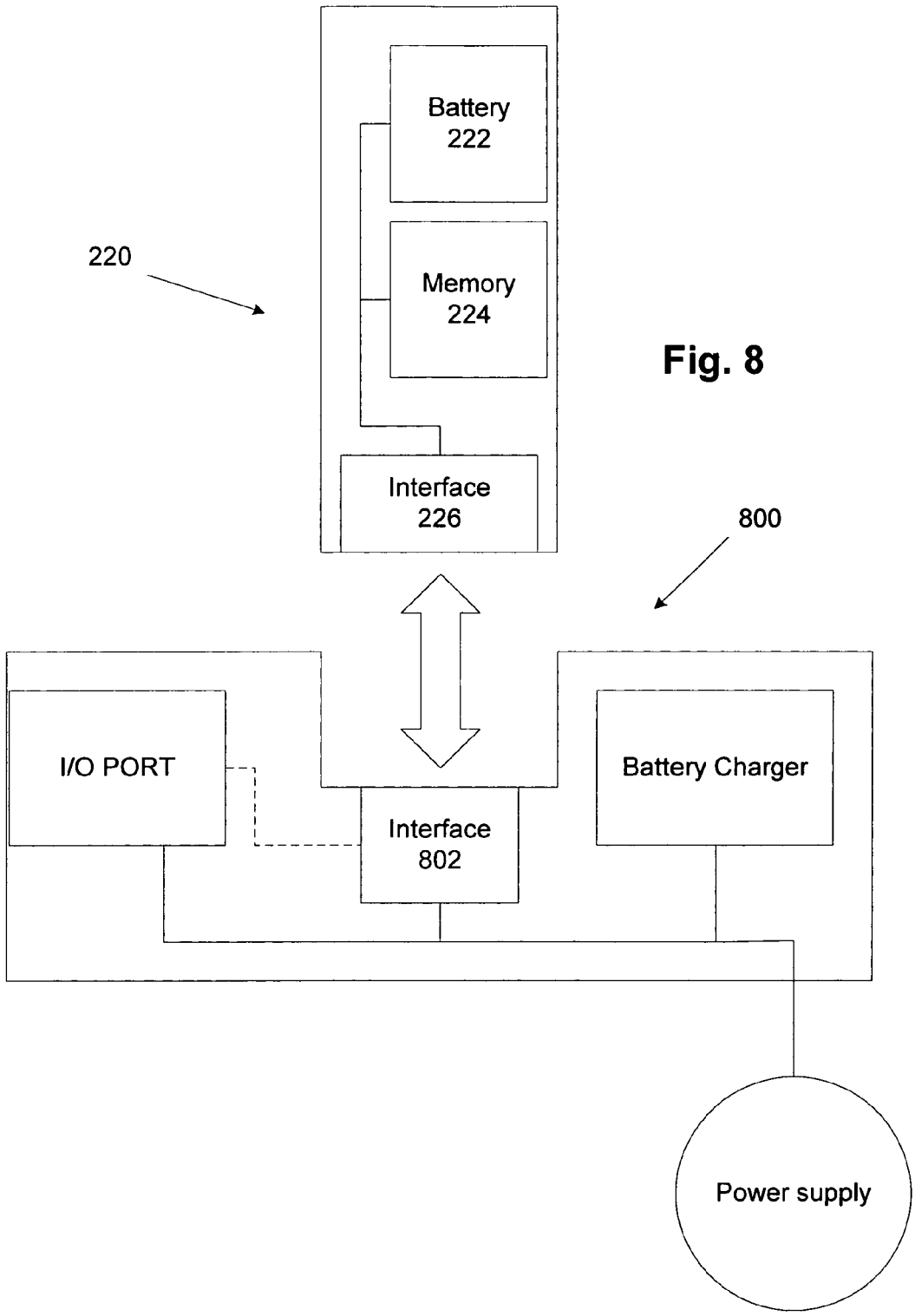
FIG. 8 is a block diagram of the removable module and initialization module.

FIG. 8 shows a device for initializing removable modules 220. Similar to the stationary transmitter 104, an initialization module 800 includes a section for receiving one or more removable modules 220 (two are shown in FIG. 8), an interface 802 for providing power and data paths to the removable modules 220, and a power supply 804. In place of data modem 302 of the stationary transmitter 104, initialization module 800 expands upon interface 802 to provide connection to an external computer.

Figure 9:
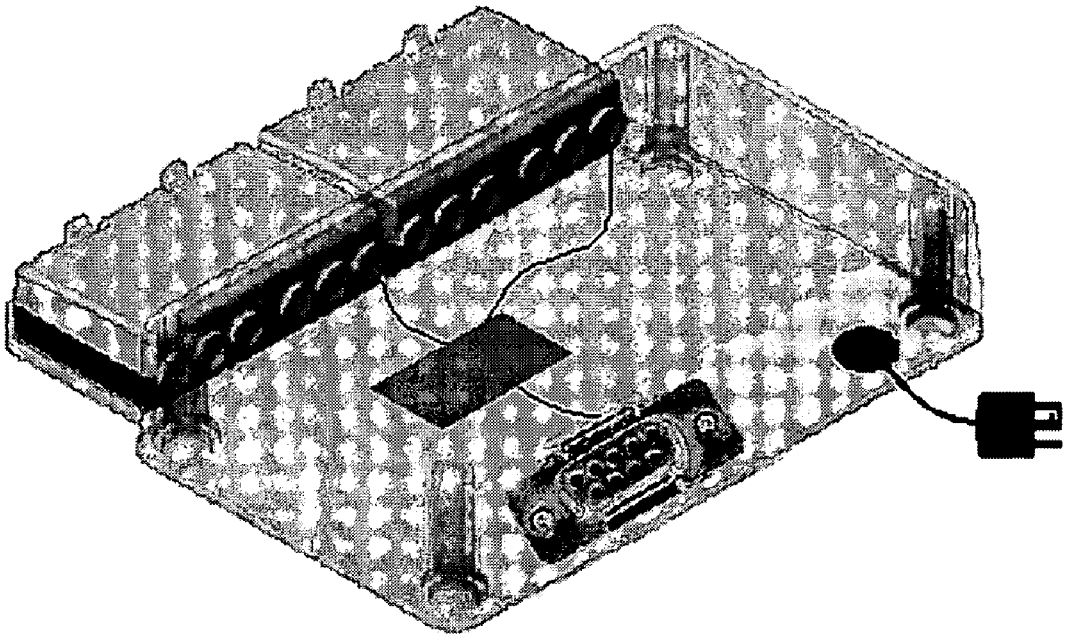
FIG. 9 is a perspective view of a the removable modules and initialization module.

FIG. 9 shows a perspective view of the preferred embodiment of initialization module 800. Interface 802 preferably includes a DB-9 serial PC interface connector that connects to a personal computer. The DB-9 connector is wired to an initialization circuit board. Software in the Parole Officer's PC allows programming of initialization data into memory 224 of each removable module 220, including the time from the PC clock, to initialize the counter in memory 224 to start the data collection. The initialization unit circuit board processes this initialization data (date/time and identification codes) and passes it to the memory 224 before removable module 220 is fitted onto the wearer's wrist-worn device at time of initial fitting.

In the preferred embodiment of the invention, the system only allows for a "downstream" data path. Specifically, GPS receiver receives GPS signals, memory receives data, and the remote location receives the history of data. Preferably, signals or information do not travel in the reverse upstream path, such that none of the components for the system operate in response to a received interrogation or signal. By way of non-limiting example, the user worn device turns ON by inserting removable module 220, which supplies power to the internal components. No other signals or commands need be received from an external source or the remote location. This configuration minimizes power consumption via a simpler design. However, other embodiments of the invention could allow for a two-way data path. Control signals may also travel upstream as necessary, such as to prompt download of data from memory 224.

The use of an external power supply 308 by stationary unit 104 allows it to include various optional features. For example stationary unit 104 may include a display or other communication methodology for the remote location to communicate with the user. For example, the remote location could forward a message for display instructing the user to call into the remote location. As shown in FIG. 7, an optional telephone jack to connect with a standard telephone may also be provided.

Stationary unit 104 is preferably only stationary to the extent that it is not tethered to the user. Stationary unit 104 can be portable if desired, and set up at any convenient location. In the alternative, stationary unit 104 can be "fixed" by requiring that the user download at a certain time and from a certain phone number, thereby assuring that the user will be at a desired location at a desired time.

The structural elements and functions described herein may be separate or combined components. For example, microcontroller 217 may include tamper resistant circuitry 216. The noted interface may be a single element that connects to the removable module 210 and outside components (e.g., a PC).

The present invention can be applied in the parole system, in which the users would be parolees. The remote location would be a station that receives crime incident data from local or national jurisdictions and compares it with movement of the parolees; this is preferably done through a database comparison, although other methodologies could be used. Any overlap suggests that the parolee may be a suspect in the crime, or a potential witness. The station could also determine whether a parolee entered a restricted area (e.g., a parolee for drunken driving may not be allowed to enter a bar or liquor store).

Smaller applications of the device, such as home use to monitor movements of children, are also within the scope and spirit of the invention. The tracking data could be used, for example, to confirm that the child was in school during school hours. In an alternative embodiment for home use, the remote location could be a home computer, and the stationary unit 104 could be directly connected to, or part of, the home computer (e.g., an I/O port).

The preferred embodiment of the invention is a "passive" system, in that the data can be used at a later date for comparison with incident data. Its power requirements and controlling circuitry are thus much smaller than an "active" system. However, as technology evolves, the present invention may be used in an active environment. Nothing herein should be interpreted as a waiver of coverage to such active systems.

In the preferred embodiment of the invention, the data collected from all of the users will be compared with incident data, such as crime data, to determine if any user was in the vicinity of a crime during the time frame, or specific time, of a crime. This preferably occurs automatically, as all crime data is compared with all movement data to determine any overlap therebetween, or "hits." The methodology for doing so would be done using known computer hardware, software, and databases configured and/or programmed to operate as disclosed herein.

In small-scale operations, a comparison of all movement data with all user location data may be too slow to provide speedy results. Searching all of the movement data to identify movement data that is more relevant to the incident can reduce this procedure.

The first such search is preferably based on a time frame of the incident. A particular incident preferably has a time frame associated with it (e.g., crime is often determined to have occurred within a window of a few hours). The total location data needed for comparison with the incident data can be reduced by searching for movement data within this time frame. In a 24 hour reporting system and a 3-hour time frame for a crime, this would reduce the amount of data for comparison with incident data by 87.5%. A 10-minute time frame would reduce the amount of data by over 99%. In addition, while it is not expected that crime data would be based on an exact time rather than a time frame, the present invention could operate on such an exact time basis.

The identification of relevant data can also be limited geographically. An area of interest would be previously broken down into zones. Individual zones may be of any shape, and may overlap into other zones. For example, the zones could be quite large for low populated areas, or relatively small for populated areas with high crime rates. Preferably, a grid is defined over a geographic area such that each square on the grid represents a ten square mile zone.

Movement data of the users can be associated with these zones. This association can be done at the circuit portion 202, at the remote location when data is received, or only to a smaller subset of movement data that has been identified as relevant (e.g., the subset of movement data from the time frame search noted above).

The crime data is also associated with these zones. For a particular incident, a boundary of the crime, or a "crime scene" is established as part of the crime data. This can be an irregular border, an area encompassed by a certain radius around the crime, or any other methodology to define an area of interest. For each area, the zones that overlap the area are identified as relevant. For example, FIGS. 10 and 11 show zones A–I with a crime area shown as a circle. In FIG. 10, the area of interest falls completely within Zone A, such that only movement data in zone A is relevant. In FIG. 11, the area of interest overlaps into all of zones A–D, such that only these zones would be relevant. The system searches the movement data (either all the data or the subset from one or more previous searches) for movement data within these zones.

The above searches will produce a subset of movement data that is significantly smaller than the total pool of movement data. This subset is then compared with the crime data to determine overlap with an area and time frame of interest (which may or may not be the same as the time frame and area used in the previous searches).

According to the preferred embodiment of the invention, the zones are associated with the movement data when received at the central location. The central location also has a database of crime incidents over a period of time each having an associated time frame, area of interest, and relevant zones. For each incident the relevant program will search the total pool of movement data consistent with a time field to produce a first subset pool of movement data. This first subset will then be searched by relevant zones to produce a second, preferably smaller, subset pool of movement data. This second subset pool is then compared with the incident to determine whether any users were in proximity to the incident within the time frame of the incident.

However, the invention is not so limited. Changes to the order of the searches, the point at which the zones are assigned, and other steps in the methodology can be adjusted as desired. Additional searches using different criteria could also be used to further narrow the subset pool of movement data for comparison with incident data.

As noted above, there may be circumstances in which GPS receiver 214 is not receiving or recording GPS data (e.g., tampering, the user entering a shielded area, etc.), such that memory 224 is only recording internally generated timestamps. In the absence of location data, the various sorting methods noted above may not identify an otherwise relevant overlap in the "hit" report. To compensate, the system can generate a secondary report to identify those individuals that are unaccounted for during the time frame of interest. Further manual or automatic searches/investigation could be used to determine the location and time at the "disappear" and "reappear" points in relative proximity to events of interest.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

By way of non-limiting example, the nature of many components of the fixed and removable modules are not fixed to those modules. Preferably, removable module 220 includes at least battery 222 and memory 224 and fixed module 210 includes tamper detection circuitry 216. The placement of the remaining elements in the preferred embodiments are consistent with minimizing production costs and the duplication of parts. However, elements such as GPS receiver 214, antenna 216, etc., could be placed in removable module 220. The variety of available distributions of such elements fall within the scope and spirit of the invention. Similarly, the configuration and location of the various circuit elements within fixed module 210 and removable module 220 are not limited to those disclosed herein.

The nature of the physical circuit elements can also be changed within the skill of the art. For example, microcontroller 214 could be a microprocessor, or eliminated completely if the control functions could be incorporated into other elements. Antenna 212 may be omitted or incorporated into GPS receiver 214 as technology evolves. GPS receiver 214 may work off of GPS, DGPS, dead reckoning, or other methodology (and may thus be thought of generically as a coordinate receiver).

What is claimed is:

1. A device for monitoring movement of an object, comprising:

a first module configured to secure to the object;

a second module, capable of electrically connecting to said first module, including at least a rechargeable battery and a memory capable of storing a history of movement data; and a third module, capable of electrically connecting with said second module, including a data modem capable of connecting to a remote station, and a battery charger;

wherein when said second module is connected to said first module, said memory periodically records available location data representing a position of said device at the time of recording;

wherein when said second module is connected to said third module, at least a portion of the contents of said memory downloads through said data modem and said battery charger charges said battery; and wherein connecting said second module to said third module does not terminate any securing relationship between the first module and the object.

2. The device of claim 1, further comprising a band capable of securing said first module to said object, said band being an electrically conductive plastic.

3. The device of claim 1, wherein said first module includes a coordinate receiver, and said battery powers said receiver when said first module is electrically connected to said second module.

4. The device of claim 1, further comprising a fourth module interchangeable with said second module.

5. The device of claim 1, further comprising an initialization module capable of initializing said memory.

6. The device of claim 1, wherein said first and second modules, when connected, have a size and shape for easy support around the limb of a user.

7. A system for monitoring movement of an object, comprising:

a first module configured to secure to said object, said first module including a coordinate receiver;

a plurality of second modules, each capable of electrically connecting to said first module, and each including at least a rechargeable battery and a memory capable of storing a history of movement data from said coordinate receiver; and a third module, capable of electrically connecting with at least one of said second modules, including a data modem capable of downloading at lease a portion of the contents of said memory of one or more of said at least one of said second modules, and a battery charger.

8. The system of claim 7, wherein when one of said second modules is connected to said first module, said memory periodically records available location data representing a position of said device at the time of recording; and wherein when said one of said second modules is removed from said first module and connected to said third module, said memory downloads through said data modem and said battery charger charges said battery.

9. The system of claim 7, further comprising tamper detection circuitry in said first module capable of logging a tamper event in said memory in response to attempted removal of said first module from the object.

10. A method for recording movement of an object, wherein a first module is attached to the object in a tamper resistant manner, comprising:

electrically connecting a second module to the first module, said second module including at least a memory and a battery;

obtaining data representing a position of said first module at a particular time;

storing said data on the memory in said second module;

repeating said obtaining and storing for a period of time;

after said period of time, disconnecting said second module from said first module and connecting the second module to a third module, the third module including at least a data modem and a battery charger;

downloading at least a portion of the contents of the memory in the second module to a remote location through the data modem; and recharging the battery in the second module via the battery charger in the third module.

11. The method of claim 10, further comprising at least one fourth module including at least a memory and a battery, said method further comprising:

connecting said fourth module to said third module substantially when said second module is connected to said first module; and connecting said fourth module to said first module substantially when said second module is connected to the third module.

12. The method of claim 10, further comprising storing tamper data in said memory in response to an attempt to remove said first module from the object.

13. A method for recording movement of an object, wherein a first module is attached to the object in a tamper resistant manner, a plurality of second modules each include at least a memory and a battery, and a third module is configured to simultaneously connect with at least some of the plurality of second modules, said method comprising:

connecting one of the plurality of second modules to the first module;

connecting at least some of the plurality of second modules to the third module;

obtaining, at said first module, data representing a position of the first module at a particular time;

storing said data on the memory in said one of the plurality of second modules;

repeating said obtaining and storing for a period of time;

after said period of time, substituting the one of the plurality of second modules with one of the at least some of the plurality of second modules, such that said obtaining, storing, and repeating will continue with the one of the at least some of the plurality of second modules;

connecting the one of the plurality of second modules to the third module;

downloading at least a portion of the contents of the memory in the one of the plurality of second modules to a remote location through the data modem; and recharging the battery in the one of the plurality of second modules via the battery charger in the third module;

wherein said substituting does not terminate the first module being attached to the object.

* * * * *